United States Patent [19]

Meinardus

[11] Patent Number: 4,522,837

[45] Date of Patent: Jun. 11, 1985

[54] METHOD OF REMOVING BRAN FROM CEREAL GRAINS

[75] Inventor: Elmond F. Meinardus, Houston, Tex.

[73] Assignee: Riviana Foods Inc., Houston, Tex.

[21] Appl. No.: 458,779

[22] Filed: Jan. 18, 1983

Related U.S. Application Data

[62] Division of Ser. No. 227,744, Jan. 23, 1981, Pat. No. 4,426,921.

[51] Int. Cl.[3] ..... B02B 3/00; B02B 3/04

[52] U.S. Cl. ..... 426/482; 426/483

[58] Field of Search ..... 426/482, 483; 99/518-531, 600-602, 605-610, 611, 603, 617-623; 241/91

[56] References Cited

U.S. PATENT DOCUMENTS

| | | | |
|---|---|---|---|
| 3,089,527 | 5/1963 | Wasserman et al. | 426/483 |
| 3,421,902 | 1/1969 | Wayne | 426/482 |
| 4,051,773 | 10/1977 | Staton | 426/482 |

*Primary Examiner*—George Yeung

*Attorney, Agent, or Firm*—Delmar L. Sroufe

[57] ABSTRACT

A method and apparatus for removing bran from cereal grains, particularly rice, wherein dehusked cereal grains to be debranned are fed under controlled pressure through a chamber wherein they are laterally confined by an apertured screen while being worked by a special bladed rotor providing pockets of grain which rotate with the rotor within and relative to the confined grain body so that the debranning action is effected mainly by grains rubbing together whereby to produce high grade unbroken polished grains efficiently and economically.

7 Claims, 7 Drawing Figures

METHOD OF REMOVING BRAN FROM CEREAL GRAINS

This application is a divisional application of my copending application Ser. No. 227,744, filed Jan. 23, 1981, now U.S. Pat. No. 4,426,921.

This invention relates to the processing of rice and other cereal grains and is particularly concerned with methods and apparatus wherein bran is efficiently removed from the grains.

Rice is a major crop and food in many countries. In some countries the most desirable rice, usually that destined for food, is so-called polished rice which has the bran surface layers removed and appears as a more or less colorless smooth unbroken grain. Rice which has been debranned without breaking or otherwise damaging the grain is more highly desired than broken grain rice. Therefore a continuing problem in the industry is to improve the production of unbroken rice free of bran as economically and as efficiently as possible.

Machines for removing bran developed over the years include generally the abrasive type wherein the rice grains are subjected to the positive action of abrasive surfaced rollers, and friction type wherein the rice grains are rubbed on metal surfaces and each other.

In its preferred embodiment the invention will be described as incorporated in rice milling apparatus, of the friction type, wherein rice grains are fed axially through a chamber defined by an apertured confining screen surrounding a milling rotor, and wherein bran is removed from the surfaces of the rice grains in the chamber and separated from the resultant polished rice grains.

Apparatus of the foregoing type has been proposed and is widely used. Probably the most well known comprises machines sometimes known as Satake machines that incorporate principles disclosed in the U.S. patents to Satake U. S. Pat. Nos. 3,078,894; 3,179,140; 3,485,280; 3,628,582; 3,750,884; 4,148,251 and 4,155,295. A related improvement to Satake machines is disclosed in Mori U.S. Pat. No. 3,435,865. Known art also includes Engelberg U.S. Pat. No. 424,602 where a rotor mills rice in a confining cylindrical perforated casing and Staton U.S. Pat. No. 4,051,773 wherein the rotor is modified to provide rice grain passages through it.

The Satake and like machines do produce debranned rice, but experience has shown that commercially available milling apparatus also produces a considerable percentage of less desirable broken rice grains. The term milling as used herein means the removal of bran from the rice grain.

Analyzing these conventional friction type machines it appears that the debranning and accompanying grain-breaking action take place to a very large extent as the rice grains are forced outwardly by the rotor and moved in rubbing contact against the metal screen surrounding the rotor. Additionally there appears to be considerable wide area abrasive contact of the metal ribs of the Satake type rotor with the grains. These observations are derived from examining the wear patterns of the rotor and screen in Satake machines. In fact in such conventional machines the interior of the screen is usually initially provided with rows of surface projections to cause abrasive action of the screen on the grains, and with continued use of the machine abasive wear on the screen results in polishing of the inner screen surface with the projections being worn and removed. It has been found that when the screen becomes so smooth as to lose its abrasive action on the grains the efficiency of bran removal reduces considerably. In the conventional machines as the screen becomes worn the bran removal efficiency can be retained for a time by lengthening the residence time of and/or increasing resistance to passage of the rice through the machine, but this often subjects the rice to undue forces that cause an increase in breakage and also accelerates screen wear. It is therefore common practice to replace smooth screens, as every three months or so in those installations.

It is the major object of this invention to provide novel methods and apparatus of removing bran from rice or like cereal grains for producing a higher yield of unbroken polished grains.

Further to this object an important feature of the invention resides in a novel method and apparatus wherein the cereal grain is moved under controlled axial pressure while being laterally confined by an apertured screen in a chamber surrounding a milling rotor, characterized in that abrasive action upon the grains by the rotor and screen is minimized and substantially all of the abrasive action causing removal of the bran from the grains results from rubbing of the grains against each other.

A further related feature of invention resides in a novel method and apparatus for milling cereal grain wherein the milling rotor is peripherally formed to carry around with it pockets of rice that have direct contact with the confined surrounding body of rice in the chamber.

Another feature of invention is the provision in the foregoing of a special bladed rotor that forms with the shaft mounting it a plurality of surface pockets of rice rotating with the rotor through the confined rice body.

It is a further feature of invention to provide a novel method and apparatus for removing bran from rice and like cereal grains wherein the grain is moved under controlled axial pressure while being laterally confined by an apertured screen of non-circular internal contour in a chamber surrounding a milling rotor, characterized in that there is a special bladed configuration on the rotor coacting with a smooth non-abrasive internal surface of the screen.

Further novel features and other objects of this invention will become apparent from the following detailed description, discussion and the appended claims taken in conjunction with the accompanying drawings.

PREFERRED EMBODIMENTS

Figure 1:
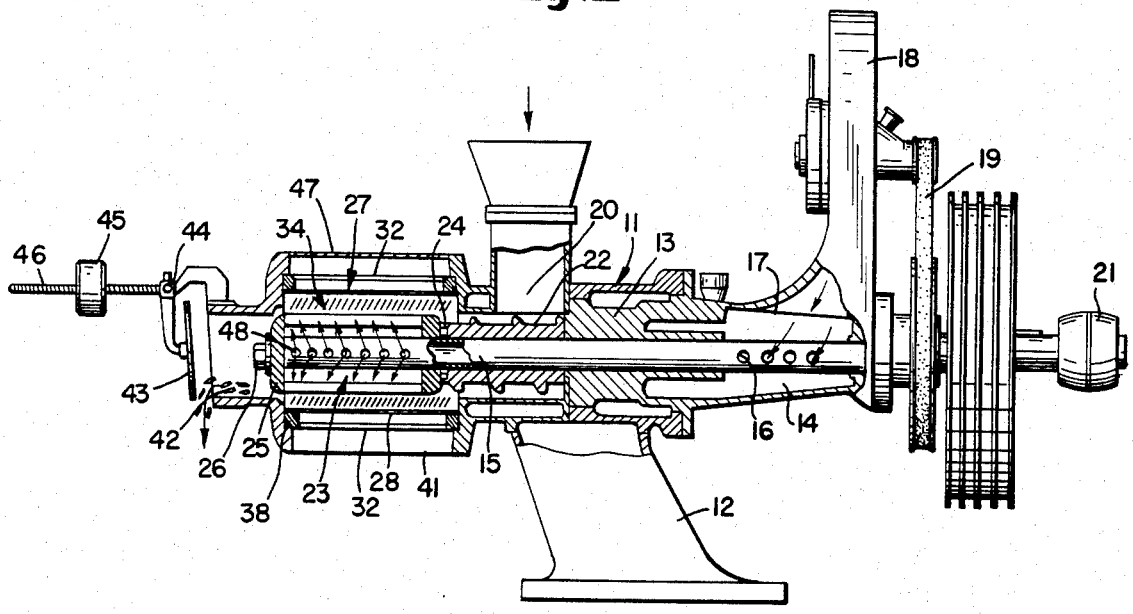
FIG. 1 is a side elevation partly in section showing a rice polishing apparatus according to a preferred embodiment of the invention.

FIG. 1 shows a rice milling apparatus containing a preferred embodiment of the invention.

A housing 11 is mounted on a stand 12 suitably bolted or otherwise rigidly secured on a floor support. An internal structure 13 provides a space 14 within one end of the housing and a generally horizontal mainly hollow shaft 15 is journalled in structure 13.

Within the housing space 14 shaft 15 is provided with one or more rows of air admission openings 16 and space 14 may be connected through opening 17 to a compressor 18 or like source of air under pressure. Compressor 18 is driven by a belt 19 from the shaft 15 which is powered by an electric motor 21.

Figure 4:
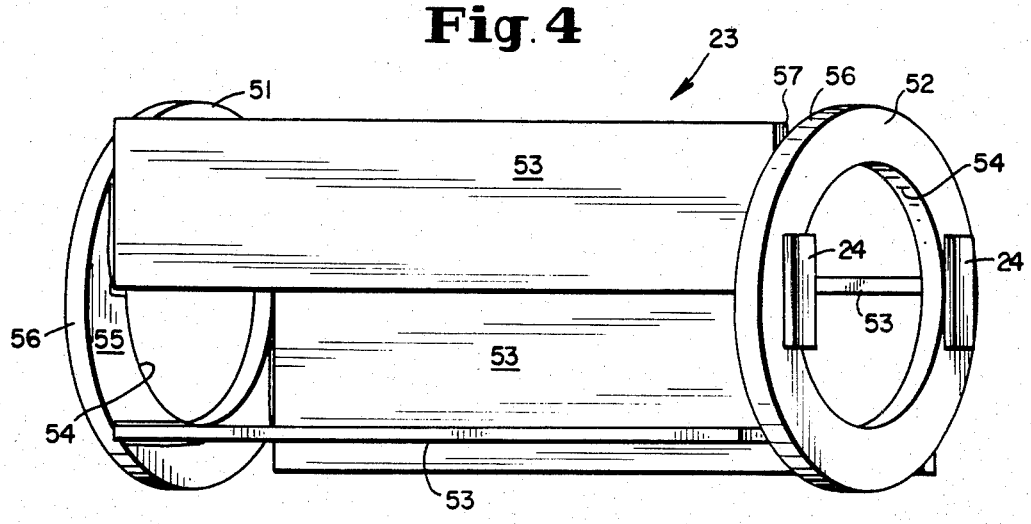
FIG. 4 is a generally perspective view showing the rotor apart from the other apparatus.

Within the housing at the other side of structure 13 the shaft 15 carries a helical rice grain feed screw 22 and a rice milling rotor 23. A housing opening 20 permits entry of rice to be milled. Screw 22 is keyed to shaft 15 for rotation therewith. Rotor 23 is longitudinally slidably mounted over the end of shaft 15 and may be formed with end drive lugs 24 (see FIG. 4) engageable with corresponding recesses in the end of screw 22. Rotor 23 is axially held on shaft 15 by a plug and abutment device 25 that is secured in place by bolt 26 to close the hollow shaft at that end and axially engage the end of the rotor. Detail of a special rotor structure that is particularly advantageous in the invention will follow.

Figure 2:
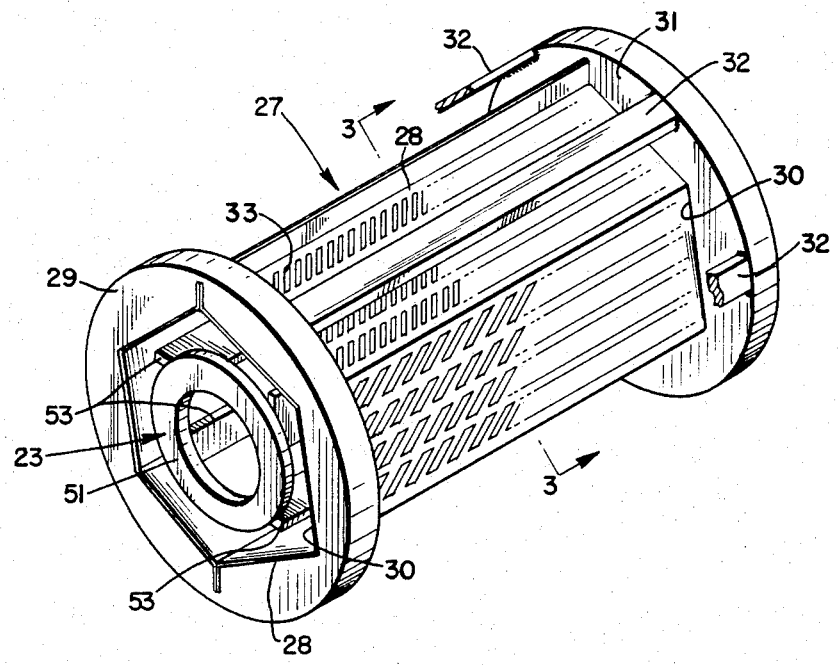
FIG 2 is a generally perspective view showing the relative arrangement of the special bladed milling rotor and the surrounding screen in the apparatus of FIG. 1, parts being removed for clarity of disclosure.

The rotor 23 is coaxially surrounded by a fixed screen assembly 27 which as shown in FIG. 2 comprises an apertured screen 28 mounted in a rigid cage formed by parallel annular end members 29 and 31 between which extend a plurality of bars 32, one of which is indicated in FIG. 2. As shown best in FIGS. 2 and 3 screen 28, which may be formed of sheet metal suitably punched or otherwise provided with a multiplicity of bran discharge apertures 33, defines a regular hexagonal envelope or confining wall in spaced relation around the rotor. Screen 28 thus establishes a milling chamber 34 around the rotor, and apertures 33 are of such size that they will not pass a grain of rice and are oriented so as not to obstruct rice grain movement axially of the chamber. Preferably the inner peripheries 30 of the members 29 and 31 are suitably hexagonal to snugly receive the screen ends, and the screen includes folds or ends indicated at 36 extending into slots 37, all for anchoring the screen against rotation.

The screen assembly 27 is seated in housing recesses 38 and suitably held against movement therein.

As shown in FIG. 1 the housing is formed with a bottom opening 41 preferably coextensively extending the length of the rotor, and with a coaxial polished rice discharge end opening 42 that is valved by a coaxial plate 43 pivoted at 44 on the housing and having an adjustable biasing counterweight 45 carried by a threaded extension 46. As plate 43 may rock about its pivot it changes its distance relative to opening 42 in operation of the machine as will appear to oppose the rice grain feeding pressure of screw 22 and control the time and rate of passage of rice through chamber 34. A housing outer wall 47 extends air tight around the cage and collects the discharged bran and directs it to opening 41.

The shaft 15 is formed with two or more longitudinal rows of air exit openings 48 each row extending substantially coextensive with the length of the rotor.

In operation generally brown rice to be debranned is continuously fed into the housing through opening 20 and axially advanced into the milling chamber 34 by the rotating screw 22. Screw 22 thus exerts a continuous pressure axially feeding the rice through chamber 34 toward discharge opening 42. Valve disc 43 is biased toward opening 42 by a counter force dependent upon the adjusted position of weight 45, which counter force effects a pressure in opposition to that of screw 22 and tends to oppose and control axial displacement of the rice column in chamber 34. Weight 45 in operation is adjusted to position plate 43 to allow a predetermined rate of discharge of rice grains through opening 42.

The rice entering and passing through chamber 34 is peripherally confined by screen 28 and subjected to the action of rotor 23. This removes bran from the rice grain surfaces and the removed bran which is powdery is eventually discharged through opening 41 and collected. Air entering shaft opening 16 exits at openings 48 as shown by arrows in FIG. 1 to pass through the rotor and thereby cool the rice being milled and to force the removed bran through screen openings 33 for collection and discharge at 41. Polished bran-free rice is continuously discharged at 42.

While for purposes of clarity of disclosure a compressed air system is shown for forcing the bran through the screen, a reversely operating suction system wherein suction is applied around the exterior of screen 28 and a filtered air admission opening provided at 17 may be employed.

The invention is here concerned with a novel method of bran removal and novel components for carrying out that method. The relative arrangement of parts is as shown in FIG. 1, but the invention embodies improvements in the rotor, screen and action at chamber 34 which result in overall improvement and efficiency of operation of the entire milling operation.

ROTOR

The bladed rotor assembly 23 of the invention is mounted on shaft 15. This rotor assembly comprises similar annular rectangular cross section end rings 51 and 52 that are parallel and rigidly interconnected by four identical longitudinal flat blades 53 welded at opposite ends to the respective end rings.

Figure 3:
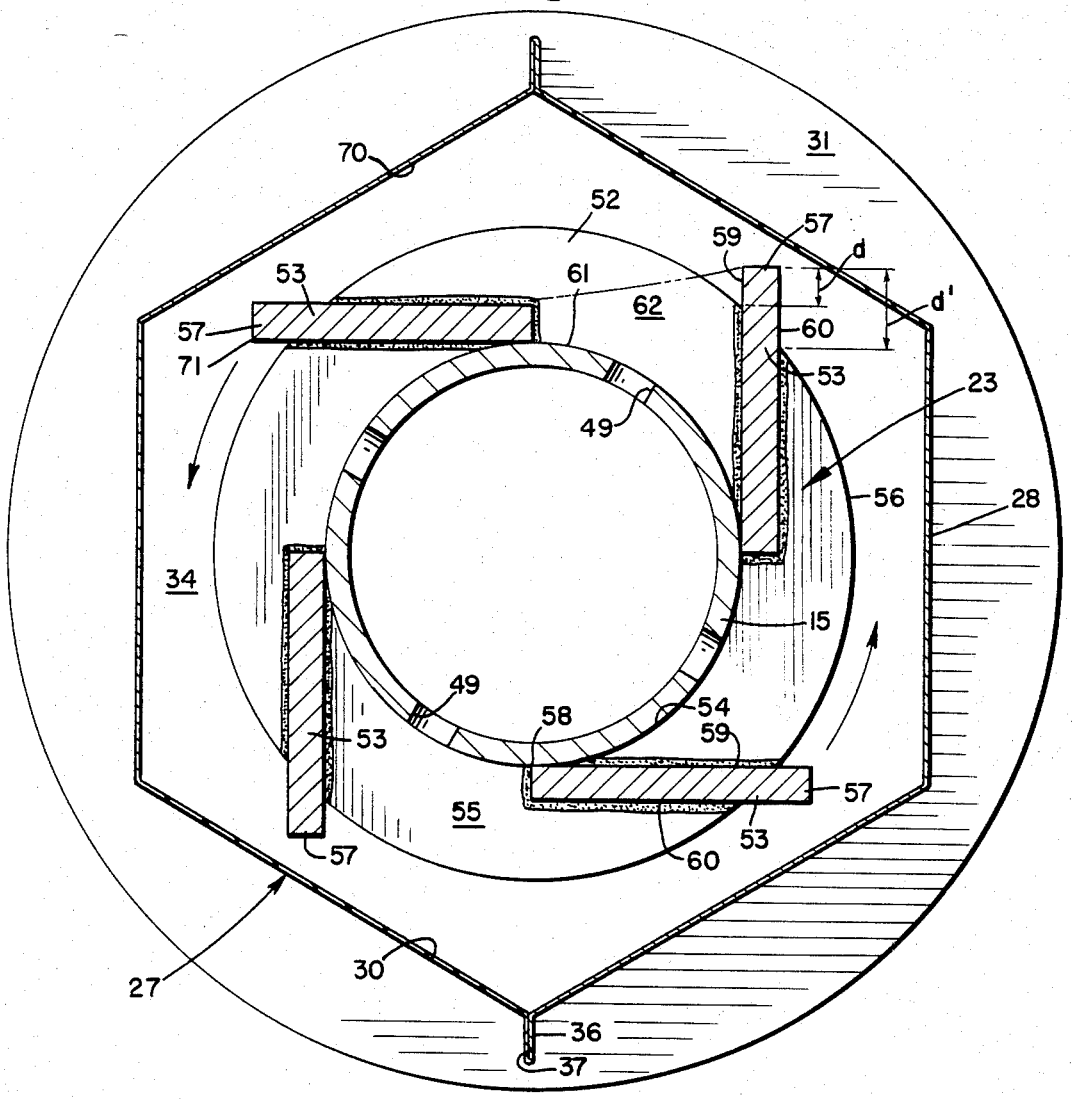
FIG. 3 is an enlarged section substantially on line 3—3 of FIG. 2 showing the rotor, milling chamber and screen association in the apparatus of FIG. 1.

The number and disposition of the blades 53 is important. As shown in FIG. 3 there are preferably four equally spaced blades 90° apart and each blade extends outwardly substantially tangentially to the inner circular periphery 54 of each end ring to traverse the flat inner surfaces 55 of the end rings, and projects beyond the cylindrical envelope defined by the outer cylindrical surfaces 56 of the end rings to appear as parallel longitudinal outward projections 57 along the rotor.

FIG. 3 is drawn substantially to scale. In a preferred embodiment the rings 51 and 52 each have an inner cylindrical periphery about $2\frac{3}{4}$ inches in diameter and a radial thickness of about $\frac{3}{4}''$ and about $\frac{1}{2}''$ axial thickness. The blades 53 are made of rectangular stock about $\frac{1}{4}''$ thick, $1\frac{7}{8}''$ wide and $8\frac{1}{4}''$ long.

The flat planar inner surface of each blade indicated at 59 in FIG. 3 extends a distance d of about $\frac{1}{4}''$ beyond the cylindrical envelope containing surfaces 56 and the parallel planar outer surface 60 of each blade extends a distance d' of about ½" beyond that envelope.

The inner peripheral diameter of the rotor end rings is such that the rotor assembly 23 has a snug sliding fit upon shaft 15 so that the inner corner 58 of each blade lies substantially on a shaft diameter.

For different shaft diameters the end ring inner peripheral dimensions may be varied to suit, but the foregoing relationship is correspondingly maintained.

In any event when the rotor is mounted on the shaft 15 as shown in FIG. 3, the flat inner face 59 of each blade defines with the outer cylindrical periphery 61 of the shaft and to some extent with the inner end of the next adjacent blade to establish an effective grain pocket indicated at 62, and in the preferred embodiment there are four of these pockets.

SCREEN

In the invention the screen inner surface defines a polygon or like shape capable of defining inwardly open pocket-like areas. The currently best known mode contour of the screen is hexagonal as shown, with the inner rice grain contacting surface 70 being desirably smooth and non-abrasive. An essential requirement according to the invention is that the inner surface of the screen be of such shape, in cross section, as not to permit mere free unimpeded rotation of the rice grain body as a whole in the chamber without relative movement of the rice grains when the rotor is turned. The inner contour of the screen must be such as to allow the rice body in the chamber to continually change its effective radial thickness as the rotor acts therein.

For use with a rotor of the dimensions given above, the screen 28 has a maximum dimension across flats of about six inches. In practice the screen may be a screen used in prior machines, except that it is preferably initially polished smooth on its inner surface. A screen bearing the usual internal projections as in prior Satake machines may work fairly well initially, and experience has shown that in coaction with the rotor of the invention the yield of unbroken polished grains actually increases as such screen wear takes place and the screen becomes smooth. After the screen becomes smooth equivalent to an initial polish little or no further wear is observed, and optimum operation ensues, as compared to conventional machines that become inefficient when the screen wears smooth.

OPERATION

In the invention brown rice is fed through housing opening 20 to be advanced by screw 22 into and through chamber 34. In order to improve the abrasive action within the chamber calcium carbonate, usually in the form of ground limestone, is mixed with the brown rice being introduced, preferably in the proportion of about 1.6% of the weight of the rice. Weighted plate 43 valves the rice discharge opening similarly to operation in conventional machines, although it has been observed that less counterforce is necessary in operation of the machine of the invention.

Motor 21 may rotate shaft 15 at the same speed as in conventional machines, namely about 575–600 rpm. It has been observed however that in the invention the shaft, and therefore rotor, speed may be increased greatly, up to double, and still obtain efficient debranning with a higher throughput and increased yield of unbroken polished rice. By the same token it has been noted that less power may be required to drive the rotor in the invention at the conventional machine speeds, thus obtaining the improved results of the invention using less energy and more economically.

Referring to FIG. 3, the rotor 23 moves in chamber 34 counterclockwise as indicated by the arrow. Clockwise rotation has proved unsatisfactory.

As the rotor rotates the leading blade edges 71 delve vigorously into and through the surrounding grain body and debranning is accomplished using mainly forces derived from rotor rotation and coacting with the screen which although it has no abrasive function imparts dynamic movement to the grains surrounding the rotor. In practice it has been observed that, as the rotor rotates it picks up and establishes on its periphery a plurality of, here four, longitudinally extending pockets of rice grains (62 in FIG. 3) that are carried as such around at the speed of the rotor.

It is important that the inner face 59 of each blade extend to provide as shown an effective pocket closure association with the periphery 61 of the shaft. Should there be a substantial space between the inner edge of the blade and the shaft grain will discharge through that space and this will result in less efficient debranning operation.

Grains in these pockets are in direct dynamic contact with the main body of grain being fed axially through chamber 34 while that body is continually subjected to an apparently pulsating generally lateral action due to rotor forces and the shaped contour, here polygonal, of the retaining screen. The resultant is a dynamic interaction of grains in chamber 34 that results in complete debranning of the grain substantially without breakage, the bran being removed from the grain essentially only by grain against grain rubbing friction. The removal bran which is about 10% by weight of the rice is discharged laterally outwardly through the screen apertures 33 due to the air pressure differential. The calcium carbonate which absorbs oil produced during abrasion of the grain is removed with the bran.

The exact theory of operation and pattern of rice movement is not known. What is known is that the above described bladed rotor acting within a smooth surfaced screen produces a higher yield of unbroken polished rice than in conventional machines, particularly those of the Satake type.

In support of a possible theory of operation observed wear patterns are noted. In conventional machines wear patterns on the surfaces of the rotor and the screen indicate that most of the abrasive debranning action takes place during passage of the grain longitudinally through the first third of chamber 34. In the invention observation shows no perceptible wear on the screen inner surface, and some abrasive wear is shown on the blades 53 but only at the leading edge 71 and that mainly along the third of the length near the grain entrance end adjacent screw 22. Thus since the invention does not rely upon abrasion at the screen, and there are minor areas of surface wear on the rotor, the active abrasion that removes the bran is believed to take place substantially only in grain to grain rubbing friction. Since grain to grain rubbing friction is less damaging than grain to metal friction such is probably the reason the invention is more efficient than conventional machines. As the grain advances in chamber 34 toward the discharge outlet 42, the coefficient of friction of the grain surfaces reduces and these more slippery grains move to the discharge opening.

In a machine of the invention having the foregoing dimensions and operated at the conventional speeds of about 600 rpm brown rice which weighs about forty-eight pounds per cubic foot passes through the chamber 34, which has a volume of about one cubic foot at a rate of about thirty-nine cubic feet per hour, the residence time of rice grains in the chamber being about one and one-half minutes.

THE INVENTION PRODUCES A GREATER PROPORTIONATE YIELD OF UNBROKEN RICE

Figure 5:
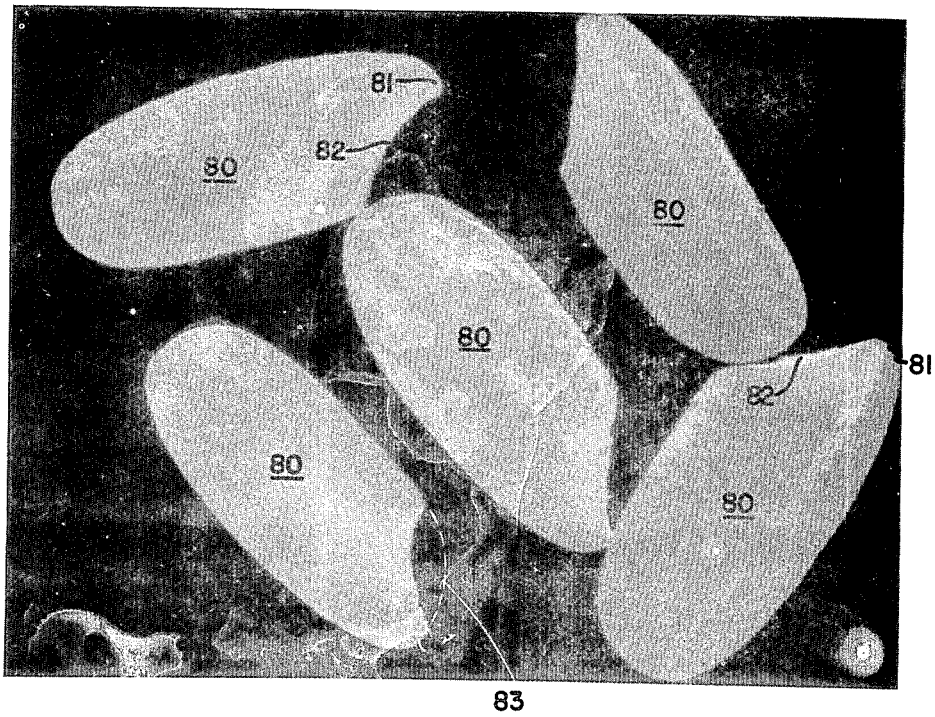
FIG. 5 is a photomicrograph illustrating unbroken polished rice grains, produced by the invention.

FIG. 5 shows a number of polished unbroken rice grains 80 produced in the invention and it will be noted that each grain exhibits at one end a reduced size hook-like tip 81 that may be identified by a white scar in the region 82. This scar results from processing of the grain during debranning and it represents generally the region where the germ indicated in dotted lines at 83 at one of the grains has been removed.

In the conventional machines such as Satake and also in the invention the germ is removed in the debranning processing and is taken off with the bran.

Figure 6:
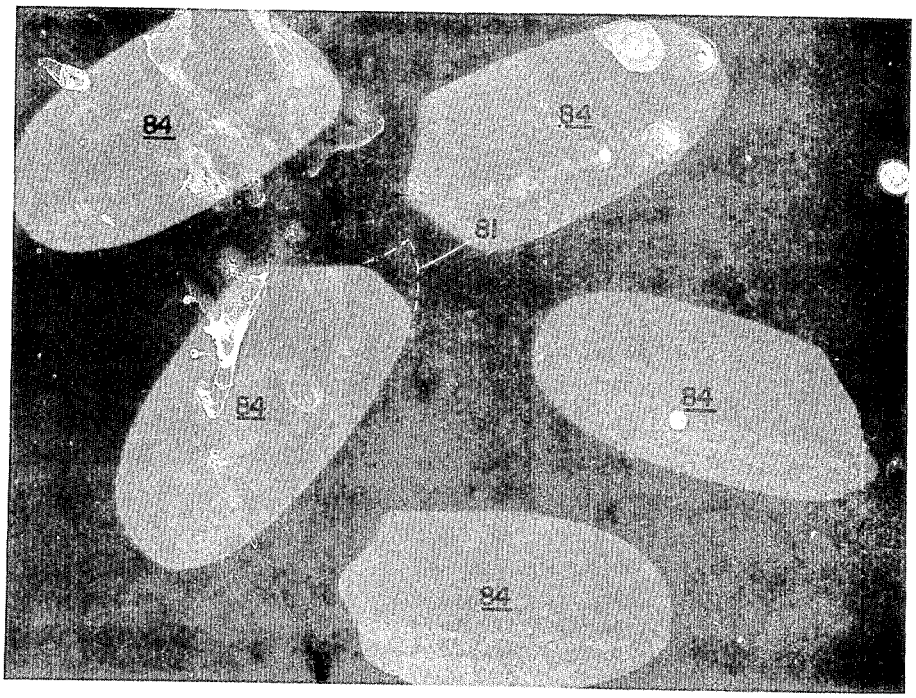
FIG. 6 is a photomicrograph illustrating a broken rice grain, illustrative of broken grains produced by hitherto conventional machines, particularly showing that the grain tip is broken off at the germ end of the grain.
Figure 7:
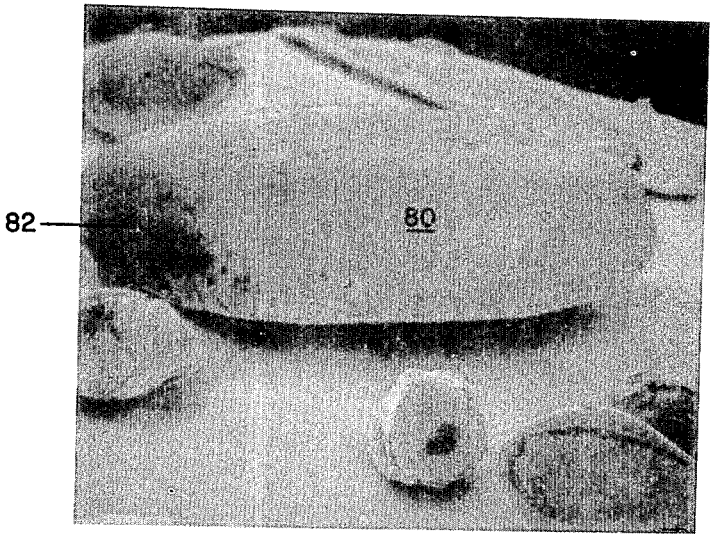
FIG. 7 is a reproduction of a photomicrograph showing several broken off fragments for scale comparison to a normal size grain of rice.

FIG. 6 shows a number of debranned grains of rice 84 that each have the tip 81 broken off, thereby representing a considerable loss of size and weight of the grain. This broken grain was processed in a Satake type machine. FIG. 7 illustrates the relative size of the broken fragments for example tips relative to the rice grain.

Tests have shown that there is a very much larger proportionate yield of these unbroken grains in the debranned rice produced by the invention than in the conventional machines. This fact has been established by microscopically examining the polished rice and the separated bran and most accurately by counting rice fragments that are found in the bran in the respective cases. The tips 81 that break off are usually small enough to pass through the screen apertures and appear as fragments in the collected bran. If some of the tips broken off are too large to pass through apertures in the screen they are retained and discharged with the rice grains and later extracted as by aspiration. Actually the bran collected from the conventional machines exhibits a different, more grayish color, from that produced in the invention probably due to the presence of more of the colorless rice fragments. The bran resulting from the invention has a smoother feel when rubbed between the fingers, as compared to that of conventional machines where the presence of relatively small rice fragments is sufficient to impart a grannular feel.

A typical sample of rice processed from a given batch of brown rice in a conventional commercial Satake machine exhibits an intact grain content of only about 75%. A grain count on another sample of the same batch of brown rice processed comparably, but according to the present invention, shows that 98% of the milled grains are intact, i.e., are free of bran and germ and are characterized by the presence of an intact germ seat region (thus, substantially all, that is at least 90%, desirably 95% and preferably at least about 98% of the milled rice grains are intact).

Milled rice of the present invention may also contain a small, significant content of chalky grains, i.e., up to 4% by weight. This content of chalky grains, which are highly fragile, is typically up to twice the content of chalky grains present in rice from the same batch milled conventionally.

For example in a body of rice produced by the invention corresponding to a conventional package size weighing at least about 200 grams substantially all of the product rice grains were unbroken and the germ seat region was intact.

MAJOR ADVANTAGES OF THE INVENTION (1) Higher yield of unbroken polished rice.
(2) Increased efficiency of entire milling operation.
(3) Reduced energy requirements during debranning.
(4) Economy in debranning increased.
(5) Screen life increased since no need to replace polished worn screens.
(6) Faster debranning. No need to pass through different pressure machines repeatedly.
(7) Rotor wear low and less critical.
(8) Improved product grain.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of processing cereal grains for efficiently removing bran with a minimum of individual grain breakage comprising:

continuously supplying dehusked grains into an end of a longitudinally extending milling chamber having an outer apertured screen to retain said grains and having within said chamber a rotationally driven rotor assembly with longitudinally extending, inwardly closed pockets facing in the direction of rotation of said rotor, said pockets being between blades extending into said chamber, forcing said grains longitudinally from said end of the chamber into said chamber with a portion thereof passing into the longitudinally extending pockets of the rotor assembly, rotating said rotor assembly to convey grains carried within said pockets around the chamber during rotation of the rotor assembly with a portion of the grains in said pockets continually engaging grains surrounding the rotor assembly whereby all of the grains in passing through the chamber move in a dynamic pattern for bran removing contact with other grains, and discharging the separated bran and processed grains from said chamber.

2. The method of claim 1 wherein the cereal grains are grains of brown rice.

3. The method of claim 1 further comprising periodically compressing the body of said grains during rotation of said longitudinal pockets while said grains are moving through said chamber.

4. The method of claim 1 wherein the internal grain contacting surfaces of said screen are smooth and non-abrasive.

5. The method defined in claim 1 wherein the separated bran passes through said apertured screen and the processed grain are separately discharged from said chamber.

6. The method defined in claim 2, wherein the internal rice grain contacting surfaces of said wall are smooth and non-abrasive.

7. The method defined in claim 1 wherein the separated bran passes through said apertured screen and the processed grains are separately discharged from said chamber.

* * * * *